US005466307A

United States Patent [19]

Tong et al.

[11] Patent Number: 5,466,307

[45] Date of Patent: Nov. 14, 1995

[54] RARE EARTH MAGNETIC ALLOY POWDER AND ITS PREPARATION

[75] Inventors: Maofu Tong; Jiancheng Jiancheng; Xiangdong Geng, all of Shanghai, China

[73] Assignee: Shanghai Yue Long Non-Ferrous Metals Limited, China

[21] Appl. No.: 87,648

[22] Filed: Jul. 6, 1993

[30] Foreign Application Priority Data

Jul. 7, 1992 [CN] China ..... 92105673.7

[51] Int. Cl.[6] ..... H01F 1/057

[52] U.S. Cl. ..... 148/302; 148/303; 420/435

[58] Field of Search ..... 148/302, 303; 420/435

[56] References Cited

U.S. PATENT DOCUMENTS

| | | | |
|---|---|---|---|
| 3,625,779 | 12/1971 | Cech | 148/101 |
| 3,748,193 | 7/1973 | Cech | 148/101 |
| 3,826,696 | 7/1974 | Cech | 148/301 |
| 3,928,089 | 12/1975 | Cech | 148/105 |
| 4,131,495 | 12/1978 | Menth et al. | 148/303 |
| 4,279,668 | 7/1981 | Kurz et al. | 148/303 |
| 4,767,450 | 8/1988 | Ishigaki et al. | 148/302 |
| 4,881,989 | 11/1989 | Yoshizawa et al. | 148/303 |
| 4,917,924 | 4/1990 | Sharma | 148/302 |
| 4,985,089 | 1/1991 | Yoshizawa et al. | 148/303 |
| 4,990,307 | 2/1991 | Camp | 148/302 |

FOREIGN PATENT DOCUMENTS

| | | | |
|---|---|---|---|
| 254529 | 1/1988 | European Pat. Off. | 148/303 |
| 372948 | 6/1990 | European Pat. Off. | 148/303 |
| 54-87630 | 7/1979 | Japan . | |
| 54-102271 | 8/1979 | Japan . | |
| 60-100638 | 6/1985 | Japan | 148/303 |
| 61-009534 | 1/1986 | Japan | 148/303 |

*Primary Examiner*—George Wyszomierski

*Attorney, Agent, or Firm*—Merchant, Gould, Smith, Edell, Welter, & Schmidt

[57] ABSTRACT

This invention relates to a rare earth containing multicomponent magnetic alloy powder consisting of no less than six components. During its preparation by reduction and diffusion process, one or more than one dispersing agent is added to the mixture of starting materials so that the allowable range of operational parameters is widened, the stability of product quality improved and the production cost reduced. Extensive studies have been made on the behavior of copper and calcium during processing making it possible to make precise compositional control of the final product. Rare earth permanent magnetic alloy powder of the $R_2Co_{17}$ type prepared in accordance with the method of this invention ensures satisfactory quality and consistency.

1 Claim, 4 Drawing Sheets

RARE EARTH MAGNETIC ALLOY POWDER AND ITS PREPARATION

BACKGROUND OF THE INVENTION

The field of application of rare earth permanent magnetic materials is extremely extensive. They are already being widely used in electronic instruments, mechanical and electrical machines, metallurgy, petroleum, telecommunication, aviation and astronavigation, military and medical industries.

Since Strnat and Hoffer discovered the magnetic anisotropy of yttrium cobalt compound $YCo_5$ in 1966, worldwide continuing efforts have been made on the exploration of better rare earth permanent magnetic materials with better magnetic properties. Tremendous progress was then made in the last few decades and was marked by the three milestones. $RCo_5$ based magnets with its maximum energy product of around 20 MGOe were referred to as the first generation magnets, $R_2Co_{17}$ type magnets with their maximum energy product of around 30 MGOe were referred to as the second generation magnets and the NdFeB type magnets with their maximum energy product of about 50 MGOe or over as announced in 1983 were referred to as the third generation magnets.

The emergence of NdFeB magnets with their amazing magnetic properties and very low cost of production has made feasible many applicaitions which would otherwise be impossible and has substantially promoted the miniaturization of many devices or instruments. However, NdFeB magnets are not without shortcomings. Low curie point, low thermal stability and rusting often place limits to their use. SmCo magnets are superior to NdFeB in these aspects but not costwise. Therefore to develop low cost SmCo magnets enabling it to survive the competition with NdFeB has been one of the current trends of research and development work.

The object of this invention is therefore to provide a modified reduction and diffusion process to reduce the production cost of the alloy of the $R_2Co_{17}$ type.

Reduction and diffusion method has long been reported for the preparation of SmCo5 alloy powder (U.S. Pat. No. 3625779, JP79-102271, JP79-87630). Since the very expensive samarium metal is no longer required and the alloy powder may be obtained without melting and crushing operations, the cost of processing is substantially lower. However, such a method is workable only for the simple binary alloy, $SmCo_5$, and the composition control would be very difficult for multicomponent systems of the $R_2Co_{17}$ type.

In order to obtain better coercivity for 2:17 alloys, copper must be added and calcium is liable to form alloy with copper thereby makig less copper available for the enhancement of coercivity.

Thus the difficulties associated with the preparation of SmCo 2:17 alloy powder are as listed below.

1. In order to compensate for the amount of copper alloyed with calcium, an excess of copper must be added. But the more copper is added, the more calcium would be consumed, thereby making the production cost higher.

2. Due to the formation of Ca-Cu alloy, the consumption of Ca and Cu would be increased. Therefore the difficulties associated with the removal of Ca and Cu in the finishing processes would accordingly be increased.

3. For reasons as stated above, the amount of metallic calcium available in the reduction process cannot be precisely controlled leading to incomplete reduction of samarium oxide. Therefore the composition of the final product often deviates from the target composition making it difficult to attain target magnetic properties.

4. In order to ensure complete reduction and diffusion reactions, the diffusion temperature is often required to go beyond 1200° C. Excessively high temperature not only shortens the service life of equipment but also tends to cause excessive loss of metal samarium in the molten state (m.p. 1072° C.) during its diffusion process.

5. Not infrequently, hard cakes are formed in the reaction mixture that require crushing prior to leaching.

Entrainment of extraneous matters cannot be fully released due to unsatisfactory particle size distribution. Oxygen content of the final product may exceed 0.2% or sometimes even 0.5%. As is known by all, excessive oxygen content in the magnetic alloy powder is detrimental.

SUMMARY OF THE INVENTION

A novel rare earth permanent magnet alloy consisting of an extra element of the boron group in the periodic table in addition to the conventional components of rare earth elements, Co, Cu, Fe and one of the refractory elements such as Zr, the composition of said alloy can be expressed by the formula $$R_2(Co_{1-a-b-c-d}Fe_aCu_bM_cE_d)_w$$

where

R stands for one or more than one of the rare earth elements such as Sm, Pr, Ce etc., M stands for one or more than one of the refractory elements such as Zr, Hf, Nb, V, Ti etc.

E stands for one or more than one of the boron group elements such as B, Al, Ga, In, Ti etc., and where

| | | |
|---|---|---|
| and where | $0.01 \leqq a \leqq 0.4$ | $0.02 \leqq b \leqq 0.20$ |
| | $0.001 \leqq c \leqq 0.10$ | $0.001 \leqq d \leqq 0.01$ |
| | $12 \leqq w \leqq 17.$ | |

The invention further provides a modified calcium reduction and diffusion process for preparing rare earth permanent magnet alloy powder, which consists of the following steps:

A. weighing out the rare earth oxide, metal powders of Co, Cu, and Fe, the oxide of one of the refractory metals and the oxide of one of the elements in the boron group as calculated from the formula set forth in claim 1, with Cu in excess, into a mixer, adding metal calcium in excess and 0.5 to 20 wt % of a dispersing agent based on the weight of the alloy powder in the same mixer and blending thoroughly, then pressing the mixed material into cakes or doughnuts for subsequent use;

B. subjecting the above described cakes or doughnuts to reduction and diffusion at 800°–1300° C.;

C. leaching the above described material with water and treating chemically to remove calcium;

D. dehydrating and drying the above described material to recover the desired alloy powder.

DETAILED DESCRIPTION OF THE INVENTION

Figure 1:
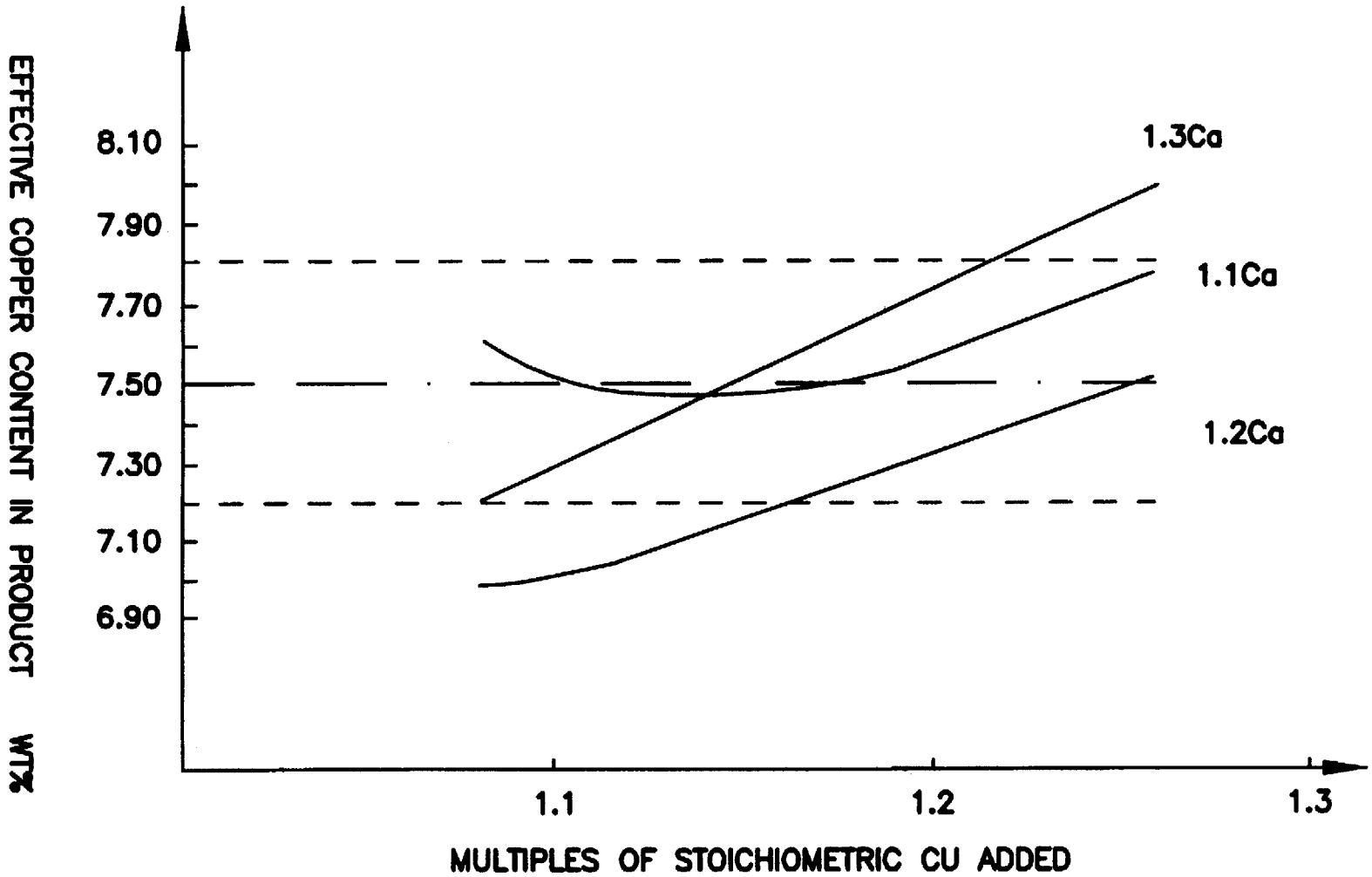
FIG. 1 is a diagram showing the effective copper content in the product as a function of the amount of copper and calicum added.

This invention relates to a novel composition of rare earth permanent magnetic alloy powder of the $R_2Co_{17}$ type and the modified reduction and diffusion method for the preparation of said alloy powder. The modified reduction and diffusion method embodied in this invention is not only applicable to the preparation of alloy powders of the $R_2Co_{17}$ type, but also adaptable to the preparation of $RCo_5$ type and NdFeB type alloy powders.

In order to overcome shortcomings in the existing reduction and diffusion process as stated above, in this invention, an extra boron group element is added to the five component system that is being used conventionally to prepare 2:17 type SmCo alloy powder. In the course of preparation by reduction and diffusion process, one or more than one dispersing agent are added to the mixture of starting materials before blending that help widen the allowable range of operational parameters. Extensive studies have been made on the behavior of Ca and Cu during reduction and diffusion process which lead to good control of the final product composition. 2:17 SmCo magnetic alloy powder prepared in accordance with the method of this invention manifests satisfactory magnetic properties.

Composition of the six component system as developed in this invention may be expressed by the formula:

$$R_2\,(Co_{1-a-b-c-d}Fe_aCu_bM_cE_d)_w$$

Where

R stands for one or more than one of the rare earth elements as Sm, Pr, Ce etc.

M stands for one or more than one of the refractory elements as Zr, Hf, Nb, V, Ti etc.

E stands for one or more than one of the boron group elements as B, Al, Ga, In, Tl etc.

and where:

| | | |
|---|---|---|
| and where: | $0.01 \leqq a \leqq 0.4$ | $0.02 \leqq b \leqq 0.20$ |
| | $0.001 \leqq c \leqq 0.10$ | $0.001 \leqq d \leqq 0.01$ |
| | $12 \leqq w \leqq 17$ | |

The processing steps according to this invention are:

1. Charge preparation and blending.

Weigh out as required by the formula the following feed materials, one or more than one of the rare earth oxides, $Sm_2O_3$, $Pr_6O_{11}$, $CeO_2$ etc; metal powders of Co, Cu, Fe; one or more than one compound such as oxides of the refractory elements; one or more than one oxide of boron group elements; calcium metal drillings; one or more than one dispersing agents e.g. $MgCl_2$, $CaCl_2$, $SmCl_3$, $BaCl_2$, $CuCl_2$, $FeCl_3$, $FeCl_3$, $DyCl_3$ etc.

The above described materials are blended for 2–8 hours under an inert atmosphere and pressed into cakes or doughnuts before charging into the reactor.

2. Reduction and diffusion.

Raise the temperature gradually in vacuum to dehydrate and degas. Purge with argon and allow the reduction and diffusion reactions to start by further heating.

$$wCo_{1-a-b-c-d}+R_2O_3+WFe_a+WCu_b+W\,(MO_2)_c+W(E_2O_3)_d+\,(2\text{–}5)Ca \rightarrow R_2\,(Co_{1-a-b-c-d}Fe_aCu_bM_cE_d)_w+(2\text{–}5)CaO$$

Thermal differential analysis indicates that strong absorption peak appears when the temperature reaches 800° C. This indicates that metal calcium melts and impregnates into the rare earth oxide and zirconium dioxide. Therefore by this time, the oxides e.g. $Sm_2O_3$ and $ZrO_2$ can easily be reduced into metal. The reduction can go to completion if the temperature is maintained at 800°–950° C. for one hour. The temperature is then raised to 1000°–1200° C. when another absorption peak appears indicating that the diffusion reaction is under way. Since the diffusion process is accompanied by many structural changes, it is considered necessary to keep the temperature unchanged for one hour. The reaction mass is then cooled.

3. Removal of extraneous matters.

1/, Removal of calcium by water leach.

When the reaction mass after reduction and diffusion is cooled down, it is impregnated in water for two hours and then wash off the $Ca(OH)_2$, CaO, $(Ca\text{-}Cu)(OH)_2$ etc. by repeated water decantation.

$$CaO+H_2O \rightarrow Ca(OH)_2\ Ca+\ 2H_2O \rightarrow Ca(OH)_2+\ H_2\uparrow Ca\text{-}Cu+\ 2H_2O \rightarrow (Ca\text{-}Cu)(OH)_2+\ H_2\uparrow$$

2/, Removal of calcium by chemicals.

After water leach, more than 95% of the calcium is already removed. The last traces of calcium and other impurities may be further removed by chemical reactions, namely, with dilute HCl or dilute acetic acid.

$$CaO+\ 2HCl \rightarrow CaCl_2+\ H_2O$$

$$CaO+\ 2HAc \rightarrow Ca\ (Ac)_2+\ H_2O$$

very small amounts of EDTA may also be added to complex the calcium and to facilitate its removal.

4, Dehydration and drying.

Water in the leached mass may be replaced by ethyl alcohol or ether. The organic solvent is taken away by drying in vacuum and the 2:17 SmCo permanent magnetic alloy powder of this invention may thus be obtained.

When preparing $R_2Co_{17}$ alloy powder by reduction and diffusion method, it is quite essential that the composition of the final product be well controlled not to depart significantly from target parameters. The interrelationship among the three components most difficult to control, namely Sm, Cu and Ca, is now discussed as below.

1. The control of copper loss and its target value in the reduction and diffusion process.

Existing technology indicates that the Ca-Cu alloy formation starts at a relatively low temperature before the reduction reaction becomes vigorous. As the temperature rises, more Ca-Cu alloy of various compositions can be formed. Even though in the process of reduction and diffusion, adequate molten metal reductant is present, capable of carrying the reduction reaction to completion, the appearance of Ca-Cu alloy would bring about tremendous difficulty in the composition control of the 2:17 type alloy. In order to obtain a suitable control of copper addition, a series of systematic experiments were performed to examine the interrelationship between copper addition and calcium addition, cf FIG. 1 (Copper addition vs effective copper content in the product). It is obvious from FIG. 1 that copper loss increases with increased calcium addition and that effective copper content in product can well be controlled when calcium addition is 1.1 and copper addition 1.1–2.5 times their respective stoichiometric amounts.

2. Calcium addition and per cent reduction of $Sm_2O_3$.

In the composition as claimed by this invention, Sm content is of vital importance. When it is less than 20%, the Fe-Co phase easily separates leading to lowered coercivity in the magnet made by this alloy powder. When it exceeds 28%, large amounts of $SmCo_5$ phase would separate leading to decreased $4\pi Ms$ of 5000 Gs or less, and its energy product would be less than 5 MGOe. It is therefore necessary to keep the Sm content strictly controlled to $20\% \leqq Sm \leqq 28\%$.

When preparing SmCo5 or NdFeB, in order to attain full reduction, it is preferable to use excess Ca, usually 1.5–2.5 times stoichiometric amount.

Figure 2:
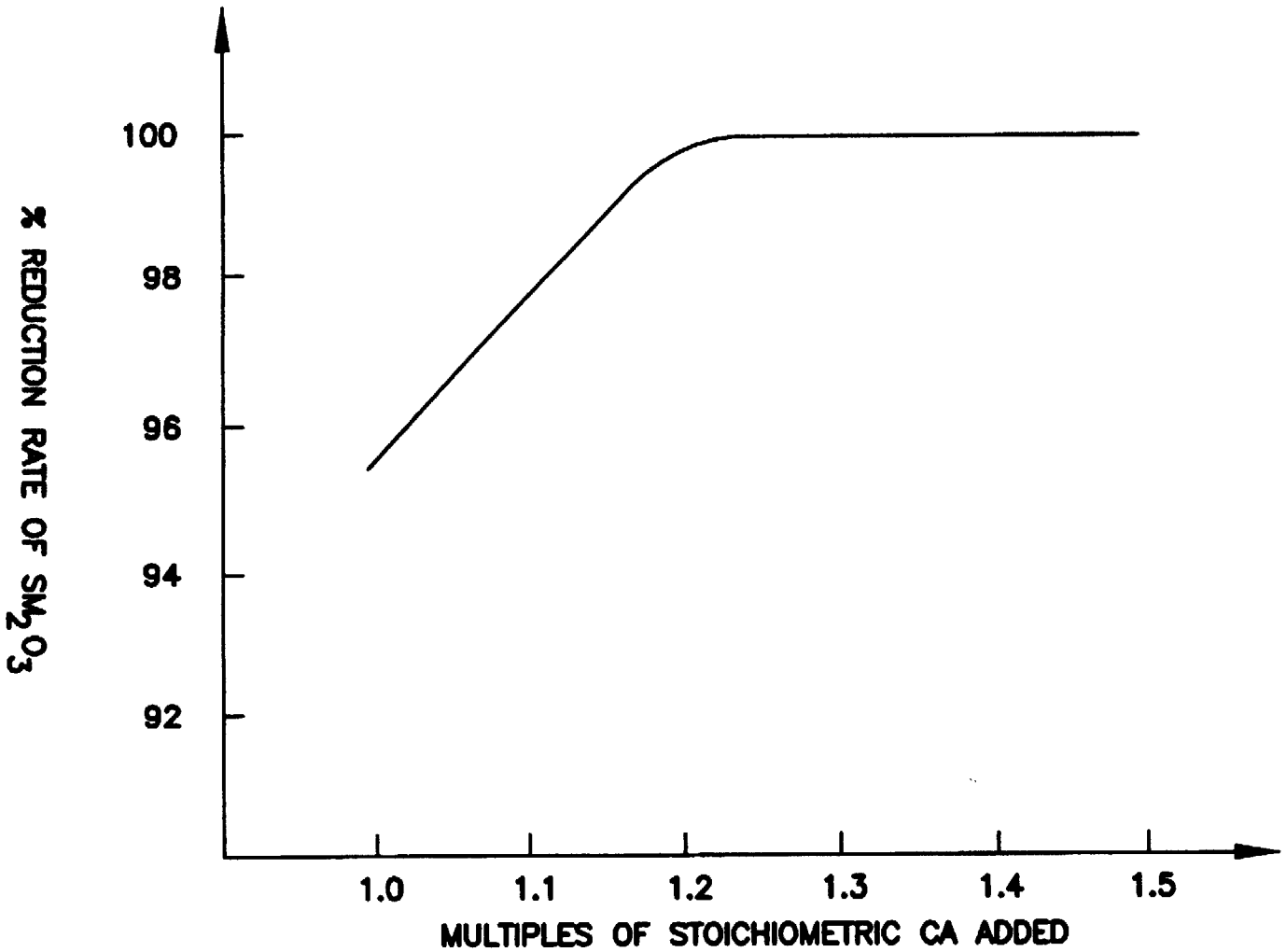
FIG. 2 is a diagram showing the reduction rate of $Sm_2O_3$ as a function of the amount of calicum added.

When preparing 2:17 type alloy powder of the six component system, the reduction process is complicated by the side reactions of forming Ca-Cu alloys of varying compositions. Therefore the calcium addition must be suitable. Either calcium drillings or calcium hydride may be used as the reductant. Thermal differential analysis indicates when the temperature reaches 800° C., absorption peak appears. By this time, calcium is already in the liquid state. So long as the temperature is maintained over 800° C., reduction reaction can be carried to completion. FIG. 2 indicates $Sm_2O_3$ reduction can go to completion if Ca addition is over 1.2 times stoichiometric amount. Since the addition of refractory oxide is very limited, generally below 4.5%, even less is the addition of boron group element, it is possible to effectively control the contents of all components within 0.6% from the target values.

In order to ensure successful operation, the effect of temperature control on the performance of the reduction and diffusion process of this invention is now discussed in detail.

In the 2:17 six component system, the melting points of the compounds of boron group elements are low, the melting points of Sm and Cu are also relatively low, being 1072° and 1083° C. respectively. Melting points of Co, Fe, Zr are higher, 1495°, 1535°, 1852° C. respectively. The temperature must therefore be sufficiently high so that the mutual diffusion between the metals may be possible. Thermal differential analysis reveals the appearance of absorption peak at 950° C., indicating that the diffusion reaction begins at that temperature. So the diffusion temperature must be at least 950° C., rendering Sm and Cu close to their liquid state. The higher is the temperature, the faster would be the diffusion reaction. But excessively high temperature such as 1300° C. would lead to excessive loss of Sm and Cu and FeB by flowing in the liquid state down to the bottom of the reactor before sufficient diffusion is attained.

Since in the six component system in accordance with this invention, boron group elements such as Al metal or FeB alloy with low melting point is incorporated, reduction and diffusion reactions can be carried to completion. As verified by actual trials, the preferable operating condition is at a diffusion temperature of 1100°–1300° C. for 2–5 hours.

The performance of the reduction and diffusion process is substantially improved by the addition of a dispersing agent, the functions of which is now described below:

The final reaction mixture after reduction and diffusion consists of not only the magnetic alloy powder and CaO, the reaction product, but also excess calcium metal, Ca-Cu alloy etc. In fact, the reaction mixture is a hard mass of magnetic alloy powder and extraneous matters like CaO, Ca, Ca-Cu etc. The hard mass obtained by the conventional reduction and diffusion method, i.e. without the addition of dispersing agents, cannot be fully disintegrated when immersed in water even after coarse crushing. Fine crushing down to a mean size of 1 mm is often required to effect complete isolation of the magnetic alloy particles from the extraneous matters. But then in the process of crushing, excessive amount of fine particles is bound to be formed simultaneously which may easily pick up oxygen in the leaching operations, and this is detrimental to the product. In this invention, one or more than one dispersing agents are added to the feed material prior to reduction and diffusion so that after reaction, the reaction mixture, a hard mass as well, can easily be disintegrated spontaneously when immersed in water. The extraneous matters after reacting with water become fluffy precipitates of $Ca(OH)_2$, $(Ca\text{-}Cu)(OH)_2$, (Ca-Cu)O, CaO or their salts soluble in water that can be easily removed by repeated decantation.

Figure 3:
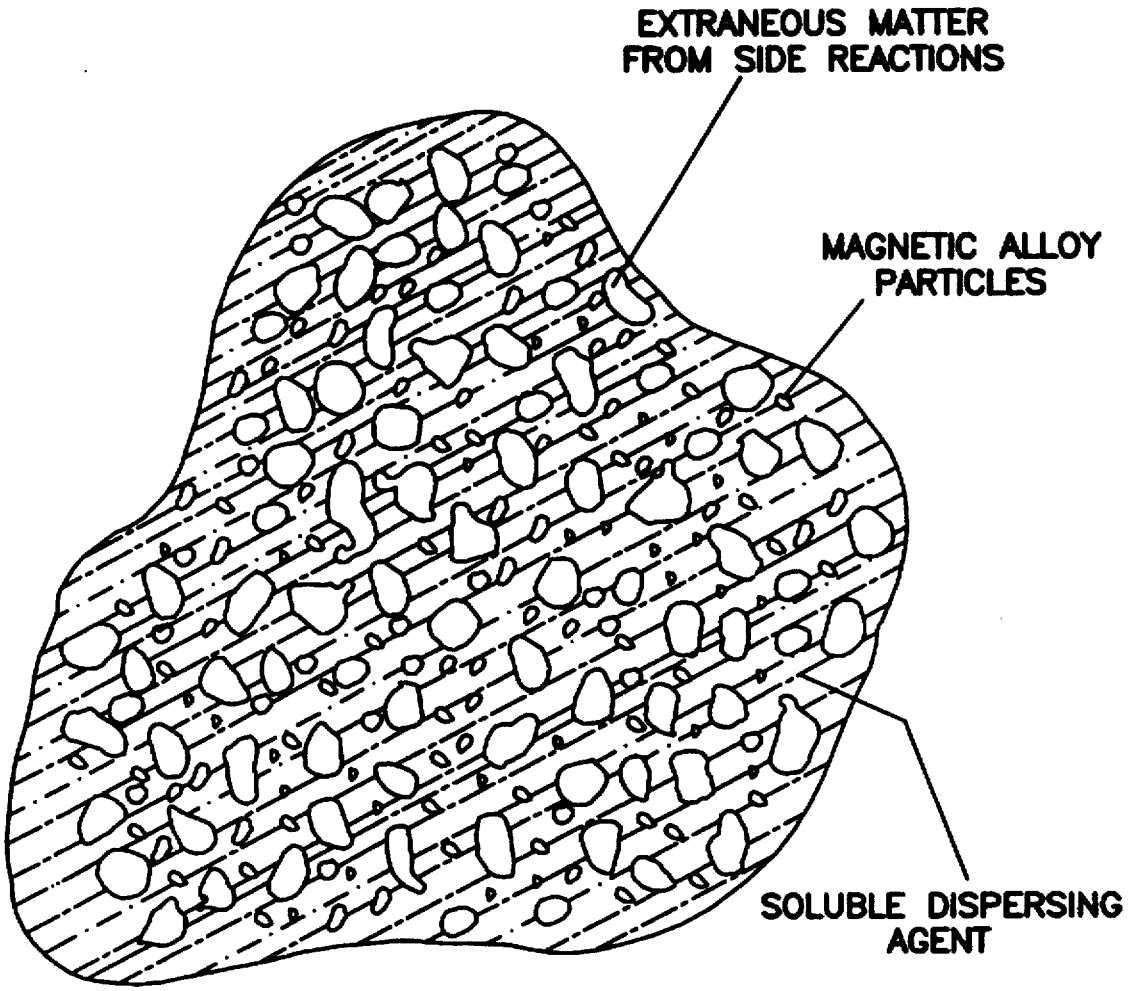
FIG. 3 is a schematic diagram depicting the effect of additions of dispersing agents.

In the reduction and diffusion method for the preparation of 2:17 type magnetic alloy powder, in order to effect complete reduction of the oxides with the unavoidable formation of Ca-Cu alloy taken into account, the reductant, calcium metal, is usually added in excess. By virtue of its low melting point, calcium metal serves not only as a reductant but also as a fairly good flux. At the reduction temperature, calcium metal begins to melt and wets the particle surface of the oxides to be reduced. The reduction reaction is therefore made much faster. Thus, the excess calcium is considered quite beneficial. However, when the reaction is complete, the magnetic alloy particles are intimately mixed with any unreacted calcium and all the reaction products such as CaO, Ca-Cu alloy particles etc, and they will all set into a hard mass making it difficult to isolate the alloy powder from the extraneous matters. The addition of dispersing agents is to coat the magnetic alloy particles and particles of side reaction products by a layer of water soluble salt (cf. FIG. 3) so that when cooled and soaked in water, the hard mass disintegrate easily because the dispersing agent forming the coating dissolves and thus releases all the particles in their free state. The extraneous matters then react with water to form fluffy precipitates of $Ca(OH)_2$, $(Ca\text{-}Cu)(OH)_2$ etc that can be easily decanted off.

In this invention, dispersing agents which have been used are: $MgCl_2$ (m.pt. 712° C.), $BaCl_2$ (m.pt. 962° C.), $CuCl_2$ (m.pt. 498° C.), $FeCl_3$ (m.pt. 300° C.), $FeCl_2$ (m.tp. 672° C.), $SmCl_3$ (m.pt. 686° C.), $DyCl_3$ (m.pt. 655° C.), $CaCl_2$ (m.pt. 772° C.). All of them proved satisfactory.

Figure 4:
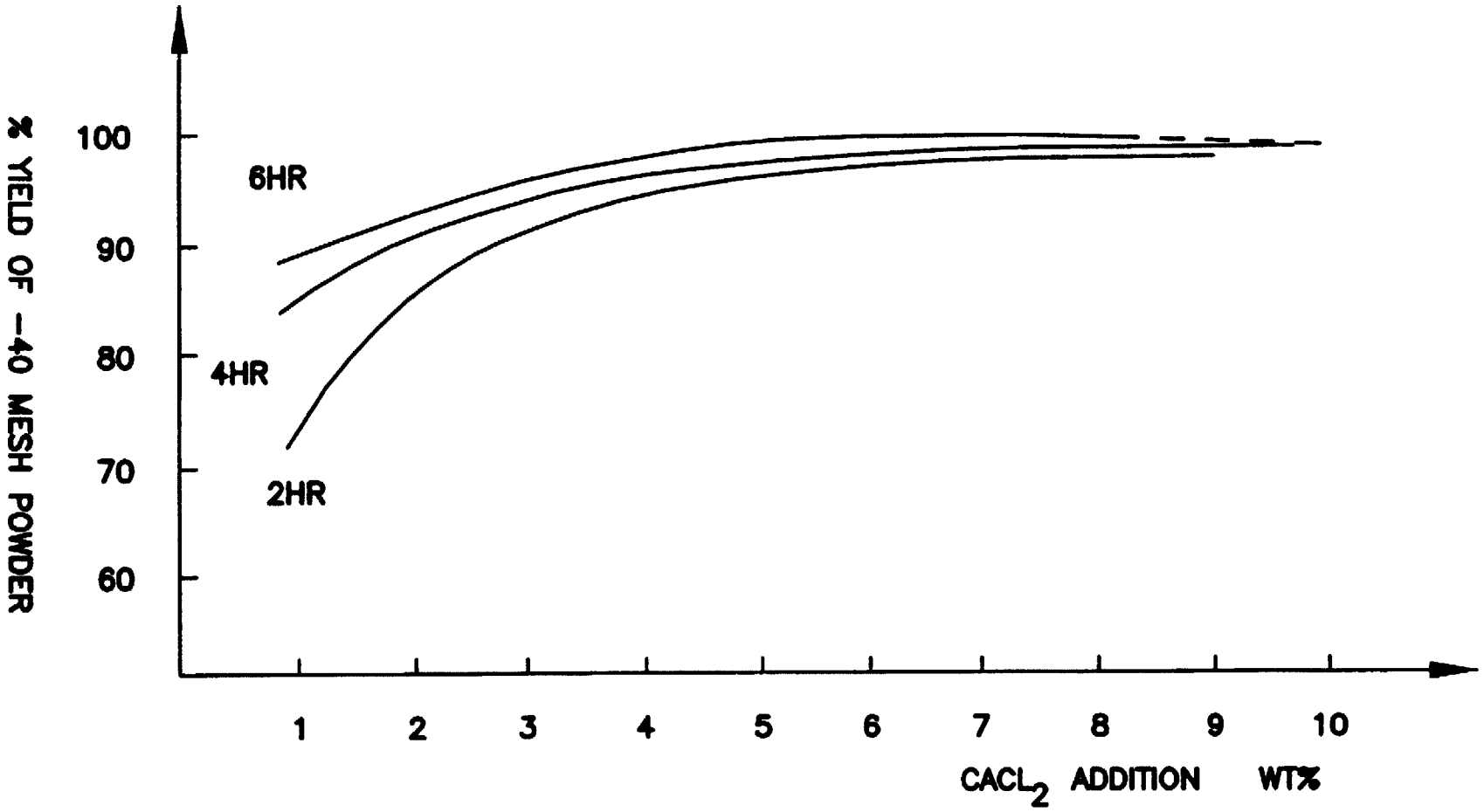
FIG. 4 is a diagram showing the percentage yield of fine powder as a function of the amount of dispersing agent added.

The action of the dispersing agent is further illustrated by FIG. 4, which indicates that with the increase of dispersing agent addition, the yield of fine powder of magnetic alloy powder increases. The ammout of the dispersing agent added is usually between 0.5 and 20% in weight. Excessive addition would lead to lower yield of product per batch, and if insufficient, the yield of fine powder fraction of the product would decrease.

The purpose of adding dispersing agents to the charge is to eliminate the difficulty to disintegrate the reaction mixture when immersed in water and to reduce the oxygen pickup which is liably larger when the reaction reaction mixture has to be adequately crushed before leaching. Since all the dispersing agents melt at 600°–1000° C., they can also act as fluxes. Both the dispersing agent and the calcium metal are melted during the reduction reaction, coating all the solid particles and forming a bridge between the solid reactants and thereby facilitating the reactions between solids, lowering the diffusion temperature and lengthening the service life of equipments. The use of dispersing agent in the reduction and diffusion process for the preparation of 2:17 rare earth permanent magnetic alloy powder is another important feature of this invention.

Following reduction and diffusion, the reaction mixture is water leached to remove the majority of calcium and then leached with either dil. HCl or dil. HAc to adjust the slurry to PH 2–5 and stirred for 0.5–1 hour so that the last traces of calcium may be further released and transformed into soluble $CaCl_2$ or $Ca(Ac)_2$ and removed by decantation. To remove the last traces of calcium by chemcial reaction, PH control is very important. High acidity facilitates calcium removal but may also lead to excessive corrosion of the magnetic alloy particles and subsequently to compositions deviated from target velues. In order to avoid corrosion of the alloy particles, buffer systems such as HAc, $NH_4Ac$ may be used. Another option is to add small amounts of EDTA which complexes the calcium allowing the dissolution of the remaining calcium bearing particles at a higher PH. It is then water rinsed to PH=6.5–7 and dehydrated by replacing the water moisture by ethyl alcohol or gasoline. Finally, after drying in vacuum, the 2:17 rare earth permanent magnetic alloy powder is obtained.

Beneficial effects of this invention are quite obvious. By the method for preparing 2:17 rare earth permanent magnetic alloy powder of this invention, it is possible to effectively control the product composition as planned in spite of the formation of Ca-Cu alloy. In addition to the many merits such as low consumption, high yield, simple procedure and low production cost, it also ensures good and consistent product quality. In addition, the permissible ranges of operating conditions in this method are substantially widened when compared with the conventional method. Generally, the operating parameters for the 2:17 type magnet preparation, such as sintering temperature, homogenizing temperature and aging temperature etc had to be strictly controlled to within 5° C. or the magnetic preperties of the magnet would be linearly degraded. When magnetic alloy powder of this invention is used, however, even a deviation of 10° C. will not produce appreciable drop of magnetic properties as compared with the conventional alloy powder. Parallel test results are listed below.

TABLE 1

| | | Parallel magnet preparation tests. | | | | | | | |
|---|---|---|---|---|---|---|---|---|---|
| | Magnetic | Sintering temperature conventional | | | | Sintering temperature 10° C. lower | | | |
| Serial No. | alloy powder | Br Gs | $_bHc$ Oe | $_iHc$ Oe | $(BH)_{max}$ MGOe | Br Gs | $_bHe$ Oe | $_iHc$ Oe | $(BH)_{max}$ MGOe |
| 84-1 | 5-component | 9750 | 7250 | 15600 | 20.3 | 8800 | 5150 | 6450 | 14.6 |
| 85-1 | 6-component | 10200 | 8100 | >15000 | 24.0 | 10050 | 7750 | 10500 | 21.2 |

Remarks: Results obtained by conventional heating schedule are compared with those sintered at 10° C. lower but otherwise the same as the conventional heating schedule.

Table 1 indicates that under identical heating schedule, the magnet made by the 6-component alloy powder is better than that made by the 5-component alloy powder. On the other hand, by lowering the sintering temperature by 10° C., magnetic properties of the magnet dropped only slightly for the 6-component alloy but drastically for the 5-component alloy.

Examples of this invention follow:

EXAMPLE 1.

Weigh out 99% $Sm_2O_3$, 32.4 g; 99% Co powder, 45.6 g; 99% Cu powder, 7 g; 99% Fe powder, 20 g; 99% FeB powder, 0.1 g; 99% $ZrO_2$, 4.5 g; 99% Ca, 19.5 g; 99% $CaCl_2$, 6 g.

After adequate blending, the mixture is pressed into cakes and charged into the reduction and diffusion furnace. The furnace is pumped to vacuum and heated up to 250° C. for one hour to remove water moisture and entrained air. Fill the furnace with argon to 0.5 kg/cm.sq. Heat up to 850° C. and keep at 850° C. for two hours. Heat up to 1100° C. and keep at 1100° C. for two hours. Further heat up to 1180° C. and keep at 1180° C. for three hours. Cool to room temperature. Take out the reaction mixture and immerse it in water, wash off the calcium by water decantation and adjust to PH=4.5 by dil. HCl and add suitable amount of $NH_4Ac$. Rinse 3–4 times with water. Finally replace the water entrained in the alloy powder by absolute alcohol and vacuum drying.

Measurement results are given in Table 2.

TABLE 2

| Element | Sm % | Co % | Cu % | Fe % | Zr % | B % | Ca % | O % |
|---|---|---|---|---|---|---|---|---|
| Target value | 27.00 | 46.00 | 5.50 | 18.50 | 3.00 | 0.02 | 0 | 0 |
| Product analysis | 27.02 | 46.22 | 5.85 | 18.20 | 3.13 | 0.02 | 0.12 | 0.17 |

EXAMPLE 2

Weigh out $Sm_2O_3$, 32.1 g; Co powder, 49.5 g; Cu powder, 7.5 g; Fe powder, 17 g; FeB powder, 0.2 g; $ZrO_2$, 4 g; Ca, 19 g; $CaCl_2$, 6 g. The preparing process is the same as in Example 1. Test results are given in Table 3.

TABLE 3

| Element | Sm % | Co % | Cu % | Fe % | Zr % | B % | Ca % | O % |
|---|---|---|---|---|---|---|---|---|
| Target value | 26.65 | 48.60 | 5.90 | 16.20 | 2.64 | 0.04 | 0 | 0 |
| Product analysis | 26.53 | 48.10 | 5.68 | 15.97 | 2.58 | 0.05 | 0.07 | 0.18 |

EXAMPLE 3

Weigh out $Sm_2O_3$, 31.66 g; Co powder, 49.38 g; Cu powder, 7.5 g; Fe powder, 16.83 g; $ZrO_2$, 3.95 g; Al, 0.014 g; Ca; 19 g; $CaCl_2$, 6 g. The preparing process is the same as in Example 1. Test results are given in Table 4.

TABLE 4

| Element | Sm % | Co % | Cu % | Fe % | Zr % | Al % | Ca % | O % |
|---|---|---|---|---|---|---|---|---|
| Target value | 26.00 | 50.00 | 5.00 | 16.50 | 2.49 | 0.014 | 0 | 0 |
| Product analysis | 25.96 | 49.01 | 5.03 | 16.51 | 2.31 | 0.021 | 0.09 | 0.11 |

EXAMPLE 4

Weigh out $Sm_2O_3$, 31.66 g; Al, 0.029 g.

Otherwise the same as in Example 3. Test results are given in Table 5.

TABLE 5

| Element | Sm % | Co % | Cu % | Fe % | Zr % | Al % | Ca % | O % |
|---|---|---|---|---|---|---|---|---|
| Target value | 26.00 | 50.00 | 5.00 | 16.47 | 2.50 | 0.03 | 0 | 0 |
| Product analysis | 25.37 | 49.07 | 5.19 | 16.19 | 2.21 | 0.04 | 0.08 | 0.13 |

EXAMPLE 5

Weigh out $Sm_2O_3$, 32 g, Co powder, 49.6 g; Cu powder, 7.46 g; Fe powder, 16.8 g; $ZrO_2$, 3.93 g; $In_2O_3$, 0.275 g.

Otherwise the same as in Example 3. Test results are given in Table 6.

TABLE 6

| Element | Sm % | Co % | Cu % | Fe % | Zr % | In % | Ca % | O % |
|---|---|---|---|---|---|---|---|---|
| Target value | 26.00 | 49.30 | 5.70 | 16.23 | 2.50 | 0.23 | 0 | 0 |
| Product analysis | 26.20 | 49.00 | 5.67 | 16.27 | 2.54 | 0.12 | 0.10 | 0.13 |

EXAMPLE 6

Weigh out $Sm_2O_3$, 32.3 g, Co powder, 49.5 g; Cu powder, 7.6 g; Fe powder, 16.8 g; $ZrO_2$, 3.9 g; $Ga_2O_3$, 0.063 g.

Otherwise the same as in Example 3. Test results are given in Table 7.

TABLE 7

| Element | Sm % | Co % | Cu % | Fe % | Zr % | Ga % | Ca % | O % |
|---|---|---|---|---|---|---|---|---|
| Target value | 26.50 | 48.00 | 6.50 | 16.45 | 2.50 | 0.05 | 0 | 0 |
| Product analysis | 26.60 | 47.34 | 6.15 | 16.23 | 2.51 | 0.05 | 0.08 | 0.24 |

EXAMPLE 7

Weigh out $Sm_2O_3$, 23.5 g; $CeO_2$, 9.3 g; Co powder, 51.0 g; Cu powder, 7.5 g; Fe powder, 16.83 g; $ZrO_2$, 3.95 g; Al powder, 0.05 g; Ca, 19.0 g; $CaCl_2$, 6.0 g.

Otherwise the same as in Example 1, The test results are given in Table 8.

TABLE 8

| Element | Sm % | Ce % | Co % | Cu % | Fe % | Zr % | Al % | Ca % | O % |
|---|---|---|---|---|---|---|---|---|---|
| Target value | 19.10 | 6.90 | 50.00 | 5.00 | 16.50 | 2.49 | 0.04 | 0 | 0 |
| Product analysis | 19.08 | 6.94 | 49.42 | 4.88 | 16.52 | 2.50 | 0.04 | 0.08 | 0.11 |

EXAMPLE 8

Weigh out $Sm_2O_3$, 3.24 g; $Pr_6O_{11}$, 26.6 g; Co powder, 49.5 g; Cu powder, 7.62 g; Fe powder, 16.8 g; $ZrO_2$, 3.95 g; Al powder, 0.04 g; Ca, 19.5 g; $SmCl_3$ 5.58 g.

Otherwise the same as in Example 1. The test results are given in Table 9.

TABLE 9

| Element | Sm % | Pr % | Co % | Cu % | Fe % | Zr % | Al % | Ca % | O % |
|---|---|---|---|---|---|---|---|---|---|
| Target value | 5.00 | 21.50 | 48.60 | 5.90 | 16.50 | 2.49 | 0.03 | 0 | 0 |
| Product analysis | 4.92 | 21.55 | 48.36 | 5.81 | 16.45 | 2.41 | 0.04 | 0.08 | 0.12 |

Magnetic alloy powders obtained in previous examples are separately ball milled to 3.5–5μ, aligned perpendicularly in a magnetic field, compacted, charged into a vacuum furnace, heated up to 1180°–1220° C. in an atmosphere of inert gas for sintering and kept at the same temperature for 2–3 hours, aged at 800°–900° C., kept at the same temperature for 2–12 hours. The magnets obtained are cooled down and cut to desired size to measure their magnetic properties.

Measurement results are given in Table 10.

TABLE 10

| Ser. No. | Residual induction Br(Gs) | Coercivity $_bHc$(Oe) | Coercivity $_iHc$(Oe) | Max. energy product $(BH)_{max}$(MGOe) |
|---|---|---|---|---|
| Example 1 | 11000 | 6750 | 7450 | 28.4 |
| Example 2 | 10200 | 8100 | >15000 | 24.0 |
| Example 3 | 10950 | 9750 | >15000 | 27.5 |
| Example 4 | 10900 | 7700 | 11150 | 25.2 |
| Example 5 | 10250 | 9050 | >15000 | 23.5 |
| Example 6 | 10350 | 9100 | >15000 | 24.1 |
| Example 7 | 9200 | 8100 | >15000 | 20.2 |
| Example 8 | 10700 | 9300 | >15000 | 27.1 |
| Reference sample | 10550 | 9400 | >15000 | 25.0 |

Remarks: The reference sample is made by conventional melting process.

What is claimed is:

1. A novel rare earth permanent magnet alloy, the composition of said alloy consisting essentially of the elements of the formula $$R_2(Co_{1-a-b-c-d}Fe_aCu_bM_cE_d)_w$$

wherein

R is one or more of the rare earth elements selected from the group consisting of Sm, Pr and Ce;

M is one or more of the refractory elements selected from the group consisting of Zr, Hf, Nb, V and Ti;

E is one or more of the boron group elements selected from the group consisting of B, Ga, and In;

and $0.01 \leqq a \leqq 0.4$, $0.02 \leqq b \leqq 0.20$, $0.001 \leqq c \leqq 0.10$, $0.0015 \leqq d \leqq 0.01$, and $12 \leqq w \leqq 17$.

* * * * *

UNITED STATES PATENT AND TRADEMARK OFFICE
CERTIFICATE OF CORRECTION

PATENT NO. : 5,466,307

DATED : November 14, 1995

INVENTOR(S) : Tong et al.

It is certified that error appears in the above-identified patent and that said Letters Patent is hereby corrected as shown below:

On the cover page, Item: [75], "Jiancheng Jiancheng" should read as --Jiancheng Xiong--.

At col. 1, line 42, "SmCo5" should read as -- $SmCO_5$--.

At col. 2, line 36, "Ti" should read as --Tl--.

Signed and Sealed this
Tenth Day of December, 1996

*Attest:*

*Attesting Officer*

Bruce Lehman

BRUCE LEHMAN

*Commissioner of Patents and Trademarks*